US011201434B2

(12) United States Patent
Nguyen et al.

(10) Patent No.: US 11,201,434 B2
(45) Date of Patent: Dec. 14, 2021

(54) DIRECT PLUG-IN CONNECTOR AND DIRECT PLUG-IN CONNECTION

(71) Applicant: Würth Elektronik eiSos GmbH & Co. KG, Waldenburg (DE)

(72) Inventors: Anh-Nguyen Nguyen, Schwäbisch Hall (DE); Michael Brodbeck, Ammertsweiler (DE); Daniel Kübler, Sulzbach Murr (DE)

(73) Assignee: WÜRTH ELEKTRONIK EISOS GMBH & CO. KG

( * ) Notice: Subject to any disclaimer, the term of this patent is extended or adjusted under 35 U.S.C. 154(b) by 120 days.

(21) Appl. No.: 16/444,227

(22) Filed: Jun. 18, 2019

(65) Prior Publication Data

US 2019/0393647 A1 Dec. 26, 2019

(30) Foreign Application Priority Data

Jun. 22, 2018 (DE) ..... 10 2018 210 233.3

(51) Int. Cl.
*H01R 4/48* (2006.01)
*H01R 13/627* (2006.01)
(Continued)

(52) U.S. Cl.
CPC ..... *H01R 13/6271* (2013.01); *H01R 4/48* (2013.01); *H01R 12/57* (2013.01);
(Continued)

(58) Field of Classification Search
CPC ..... H01R 13/6271; H01R 4/48; H01R 12/57; H01R 12/58; H01R 12/7011;
(Continued)

(56) References Cited

U.S. PATENT DOCUMENTS 4,025,142 A * 5/1977 Huber ..... H01R 12/79 439/470
5,117,330 A * 5/1992 Miazga ..... H05K 3/301 174/138 G
(Continued)

FOREIGN PATENT DOCUMENTS

CN 101552390 A 10/2009
CN 202352858 U 7/2012
(Continued)

*Primary Examiner* — Tho D Ta
(74) *Attorney, Agent, or Firm* — Boyle Fredrickson, S.C.

(57) ABSTRACT

The invention relates to a direct plug-in connector for making electrical contact with printed circuit boards, comprising a housing and at least one contact, which is connected to the housing, for insertion into a first passage opening of a printed circuit board, which first passage opening is electrically conductive on the inner wall, wherein at least one latching device for securing the housing on the printed circuit board is provided, wherein the latching device has at least one elastically resilient latching arm which is integrally connected to the housing and has a latching projection in the region of its free end, wherein the latching arm and the housing are separated by means of an intermediate space which runs perpendicularly to a supporting face of the direct plug-in connector on the printed circuit board and in a straight line.

13 Claims, 19 Drawing Sheets

(51) Int. Cl.

| | |
|---|---|
| ***H01R 12/57*** | (2011.01) |
| ***H01R 12/70*** | (2011.01) |
| ***H01R 12/71*** | (2011.01) |
| ***H01R 12/72*** | (2011.01) |
| ***H01R 13/26*** | (2006.01) |
| ***H01R 13/502*** | (2006.01) |
| ***H01R 13/66*** | (2006.01) |

(52) U.S. Cl.
CPC ..... *H01R 12/7011* (2013.01); *H01R 12/716* (2013.01); *H01R 12/721* (2013.01); *H01R 13/26* (2013.01); *H01R 13/502* (2013.01); *H01R 13/665* (2013.01)

(58) Field of Classification Search
CPC ..... H01R 12/7023; H01R 12/716; H01R 12/721; H01R 13/26; H01R 13/502; H01R 13/655; H01R 4/2433
See application file for complete search history.

(56) References Cited

U.S. PATENT DOCUMENTS

| | | | | |
|---|---|---|---|---|
| 6,050,845 | A | 4/2000 | Smalley, Jr. et al. | |
| 6,371,802 | B1 * | 4/2002 | Smalley, Jr. ..... | H01R 12/7023 439/567 |
| 6,435,897 | B1 * | 8/2002 | Paul ..... | H01R 12/7005 439/374 |
| 7,357,670 | B2 * | 4/2008 | Tanaka ..... | H01R 12/7017 439/567 |
| 7,798,819 | B2 | 9/2010 | Kudo et al. | |
| 7,878,834 | B2 * | 2/2011 | Sherman ..... | H05K 3/325 439/324 |
| 8,632,346 | B2 * | 1/2014 | Wittig ..... | H01R 4/184 439/82 |
| 10,665,970 | B2 * | 5/2020 | Geske ..... | H01R 12/585 |
| 2003/0181097 | A1 * | 9/2003 | Hattori ..... | H01R 12/7052 439/567 |
| 2006/0234562 | A1 * | 10/2006 | Lin ..... | H01R 24/50 439/668 |
| 2007/0066098 | A1 * | 3/2007 | Liard ..... | H01R 12/7023 439/79 |
| 2009/0186520 | A1 * | 7/2009 | Kondo ..... | H05K 3/301 439/567 |
| 2015/0222029 | A1 | 8/2015 | Neu et al. | |
| 2018/0040971 | A1 | 2/2018 | Phillips et al. | |
| 2018/0219332 | A1 | 8/2018 | Brungard et al. | |

FOREIGN PATENT DOCUMENTS

| | | | | |
|---|---|---|---|---|
| CN | 204156143 | U | 2/2015 | |
| CN | 205070052 | U | 3/2016 | |
| CN | 205452662 | | 8/2016 | |
| CN | 106329177 | A | 1/2017 | |
| CN | 107359442 | A | 11/2017 | |
| CN | 206619719 | U | 11/2017 | |
| CN | 207442040 | U | 6/2018 | |
| DE | 10124610 | | 11/2002 | |
| DE | 202016105358 | | 1/2018 | |
| DE | 202018100416 | | 2/2018 | |
| DE | 102018101670 | B3 * | 4/2019 | ..... H01R 12/716 |
| EP | 0631351 | | 12/1994 | |
| JP | S51-162972 | | 12/1976 | |
| JP | S52-123695 | | 9/1977 | |
| JP | S62-186375 | | 11/1987 | |
| JP | H03-127777 | | 12/1991 | |
| JP | 2001-093604 | | 4/2001 | |
| KR | 20150056824 | A | 5/2015 | |

* cited by examiner

DIRECT PLUG-IN CONNECTOR AND DIRECT PLUG-IN CONNECTION

FIELD OF THE APPLICATION

The invention relates to a direct plug-in connector for making electrical contact with printed circuit boards, comprising a housing and at least one contact, which is connected to the housing, for insertion into a first passage opening of a printed circuit board, which first passage opening is electrically conductive on the inner wall. The invention also relates to a direct plug-in connection comprising at least one direct plug-in connector according to the invention and one printed circuit board.

BACKGROUND

The aim of the invention is to provide an improved direct plug-in connector and an improved direct plug-in connection.

SUMMARY

According to the invention, a direct plug-in connector having the features of claim 1 and a direct plug-in connection having the features of claim 13 are provided to this end. Preferred embodiments of the invention are indicated in the dependent claims.

The direct plug-in connector according to the invention is provided for making electrical contact with printed circuit boards. The direct plug-in connector has a housing and at least one contact which is connected to the housing. The contact is provided for insertion into a first passage opening of a printed circuit board, which first passage opening is electrically conductive on the inner wall. Direct plug-in connectors of this kind are also called SKEDD connectors. The direct plug-in connector has at least one latching device for securing the housing to the printed circuit board, wherein the latching device has at least one elastically resilient latching arm which is integrally connected to the housing. The latching arm has a latching projection in the region of its free end. The latching arm and the housing are separated by means of an intermediate space. The intermediate space can run perpendicularly to a supporting face of the direct plug-in connector on the printed circuit board. The intermediate space can run in a straight line. At least one further positioning projection which is rigidly and integrally connected to the housing and protrudes beyond the supporting face of the housing is provided. A reliable and easy-to-operate latching device which provides secure holding and at the same time is simple to produce can be provided by means of the direct plug-in connector according to the invention in a surprisingly simple manner. Since the latching arm is integrally connected to the housing, the housing and the latching arm can be integrally produced together, for example by means of plastic injection moulding. The latching arm can be operated between two fingers of a human hand in a particularly simple manner.

In one development of the invention, a height of the intermediate space between the supporting face and a connection point at which the latching arm and the housing are connected to one another corresponds at least to half the height of the housing.

In this way, the latching arm is connected in a sufficiently flexible manner in order to be able to latch to the printed circuit board without problems and in order to be able to also release the latching again without problems.

A height of the intermediate space advantageously lies between half and 9/10 the height of the housing.

In this way, the resilient connection of the latching arm can be designed in a highly mobile manner and such that it can be operated by hand without problems.

In one development of the invention, a side face of the housing and a side face of the latching arm, wherein these two side faces delimit the intermediate space, merge with one another in an arcuate manner at a connection point at which the latching arm and the housing are connected to one another.

An arcuate configuration of the transition ensures uniform distribution of forces so that no notching effects which could possibly damage the material in the region of the connection point occur. A spring rate between the latching arm and the housing can be set by means of configuration of the arcuate transition, for example the height and the radius of the bend.

In one development of the invention, the latching projection at the free end of the latching arm is directed away from the housing.

In this way, the latching projection can be unhooked by way of the latching arm being moved towards the housing. This can be done by means of pushing the housing and the latching arm together between two fingers.

In one development of the invention, an insertion slope which leads onto the latching projection is provided at the free end of the latching arm.

An insertion slope of this kind can be used to automatically deflect the latching projection and therefore also the latching arm when the direct plug-in connector is pushed in the direction of the printed circuit board. In the process, the latching projection can be deflected, by being pressed in, until it has crossed a passage opening in the printed circuit board and snaps in behind the opening of the passage opening. The housing can then be released from this latched position again by way of the latching arm being manually deflected until the latching projection can once again extend through the passage opening in the printed circuit board.

In one development of the invention, the housing has at least one further positioning projection which is rigidly and integrally connected to the housing and protrudes beyond the supporting face of the housing.

A positioning projection of this kind can be used to hold the direct plug-in connector in a predefined position on the printed circuit board, wherein fixing of the direct plug-in connector is effected in interaction with the latching arm and the latching projection. Two positioning projections are advantageously provided, so that the housing and therefore the contact which is inserted into the passage opening of the printed circuit board cannot be unintentionally tilted, twisted and as a result damaged.

In one development of the invention, the housing has a latching arm on each of two opposite side faces.

An arrangement of the latching arms in this way allows the two latching arms to be pushed towards the housing and as a result to be unhooked from matching passage openings in the printed circuit boards in a particularly simple manner. By way of example, an arrangement of this kind is selected when a plurality of contacts are arranged next to one another in a housing of a direct plug-in connector.

In one development of the invention, the housing is provided with at least one dovetail-like groove and at least one dovetail-like tongue.

Grooves and tongues of this kind, which are designed so as to match one another, can secure a plurality of housings of direct plug-in connectors to one another in an interlocking manner and as a result relatively large plugs with a plurality of contacts can also be individually constructed.

In one development of the invention, the housing is of two-part design, wherein a first housing part is provided with the at least one latching arm and a second housing part is provided with the contact.

In one development of the invention, the first housing part is designed in general in a u shape with two limbs and the second housing part is accommodated between the limbs of the first housing part.

In this way, the first housing part engages over the second housing part. Since the first housing part is provided with the at least one latching arm and the second housing part is provided with the contact, the contact or the contacts is/are secured on the printed circuit board by the second housing part.

In one development of the invention, the contact has at least one insulation-displacement contact for connection to at least one cable strand, wherein the first housing part bears against the insulation-displacement contact in the state in which the first housing part and the second housing part are connected.

In this way, the second housing part can be used for laying a cable strand or a plurality of cable strands. By way of example, cable strands to be laid are secured to a bottom side of the first housing part. If the first housing part is then pushed onto the second housing part, the cable strands are pushed into insulation-displacement contacts in the second housing part at the same time. In the state in which it is connected to a printed circuit board, the first housing part then ensures that the two housing parts and the contacts are secured to the printed circuit board.

The problem on which the invention is based is also solved by a direct plug-in connection comprising at least one direct plug-in connector according to the invention and one printed circuit board, wherein the printed circuit board has at least one first passage opening, which is electrically conductive on the inner wall, for inserting the contact and at least one second passage opening for inserting the latching projection and/or a positioning projection of the housing.

A direct plug-in connection of this kind is functionally reliable, easy to insert and can also be removed from the printed circuit board again in a simple manner and without the aid of a tool by simply unhooking the latching projections.

BRIEF DESCRIPTION OF THE DRAWINGS

Further features and advantages of the invention can be found in the claims and the following description of preferred embodiments of the invention in conjunction with the drawings. Individual features of the different embodiments illustrated can be combined with one another in any desired manner here without going beyond the scope of the invention. This also applies if individual features are combined with other individual features without further individual features together with which they are described or illustrated. In the drawings:

DETAILED DESCRIPTION

Figure 1:
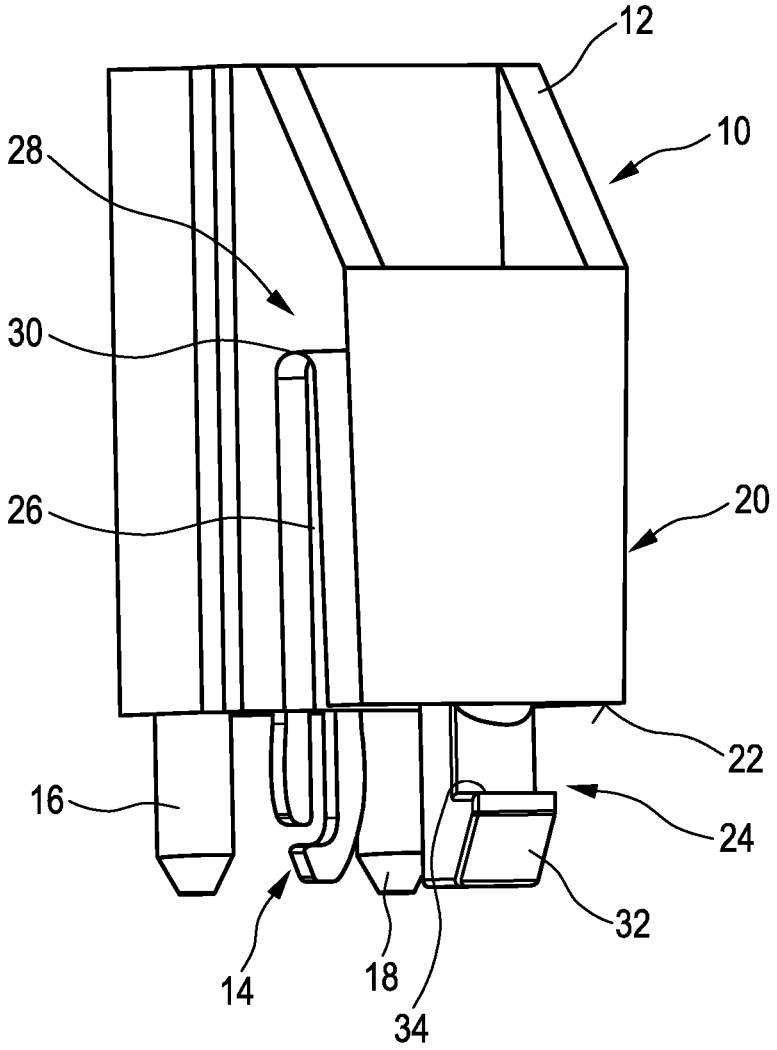
FIG. 1 shows a view of a direct plug-in connector according to the invention in line with a first embodiment of the invention obliquely from the front.

FIG. 1 shows a direct plug-in connector 10 in line with a first embodiment of the invention. The direct plug-in connector 10 has a housing 12 and a contact 14 which is arranged in the housing in sections. The contact 14 is connected to the housing 12 within the said housing. The contact 14 is designed as a so-called direct plug-in contact or SKEDD contact. The two spring arms of the contact 14 which protrude from the bottom side of the housing 12 can be moved towards one another and away from one another again in a spring-like manner. A spring movement of this kind is required when the contact 14 is inserted into a passage opening of a printed circuit board, which passage opening is electrically conductive on the inner wall. However, the contact 14 is fixed relative to the housing 12 in and against the insertion direction, that is to say from top to bottom and, respectively, from bottom to top in FIG. 1. The contact 14 has a connection end, not shown in FIG. 1, to which a cable strand can be connected. A connection end of this kind can be embodied, for example, as an insulation-displacement contact or as a crimp contact or in another suitable manner.

In order to ensure that the housing is secured to the printed circuit board and not accidentally twisted, pulled away or else merely cannot be moved excessively relative to the printed circuit board in the state in which the contact 14 is inserted, the housing is provided with two positioning projections 16, 18 in the form of pins which are embodied in the manner of a truncated cone at the tip but otherwise are cylindrical and protrude beyond the bottom side of the housing 12, which bottom side forms the supporting face on a printed circuit board at the same time. The positioning pins 16, 18 engage into matching passage openings of a printed circuit board and prevent the housing 12 from being twisted or displaced on the printed circuit board. Since the positioning pins 16, 18 are embodied in a cylindrical manner, apart from at their truncated cone-like insertion end, they cannot prevent the housing 12 from being pulled away from the printed circuit board.

In order to latch the housing 12 to the printed circuit board, a latching arm 20 is provided, which latching arm is elastically resilient and integrally connected to the housing 12 and is provided with a latching projection 24 at its free end which is arranged below the supporting face 22 of the housing 12 in FIG. 1. The latching arm 20 is separated from the housing by an intermediate space 26 which runs in the upwards direction starting from the supporting face 22. The intermediate space 26 runs in a straight line and perpendicularly to the supporting face 22, that is to say also perpendicularly to a printed circuit board onto which the direct plug-in connector 10 is mounted.

The intermediate space 26 is delimited by an arcuate end 30 in the region of a connection point 28 at which the latching arm 20 is integrally connected to the housing 12. As already shown in FIG. 1, the latching arm 20 can be pushed slightly towards the housing 12 in a resilient manner and then automatically springs back to the position illustrated in FIG. 1 again. A width of the intermediate space 26 is reduced during this movement of the latching arm 20 and the housing 12 towards one another. In the process, the arcuate end 30 of the intermediate space 26 prevents notch stresses occurring in the region of the connection point 28 and therefore prevents the material in the region of the connection point 28 being destroyed or weakened. A spring rate between the latching arm 20 and the housing 12 can be set by configuring the arc shape or moving the end 30 in the upwards direction.

The latching projection 24 is provided with a run-on slope 32 which is arranged such that the latching projection 24 and therefore also the latching arm 20 are pushed in the direction of the housing 12, that is to say backwards and to the left in FIG. 1, when they are inserted into a matching passage opening of a printed circuit board. This displacement movement continues until the latching projection 24 is pushed completely through the printed circuit board and snaps in behind the bottom face of the printed circuit board by way of its undercut 34.

Figure 2:
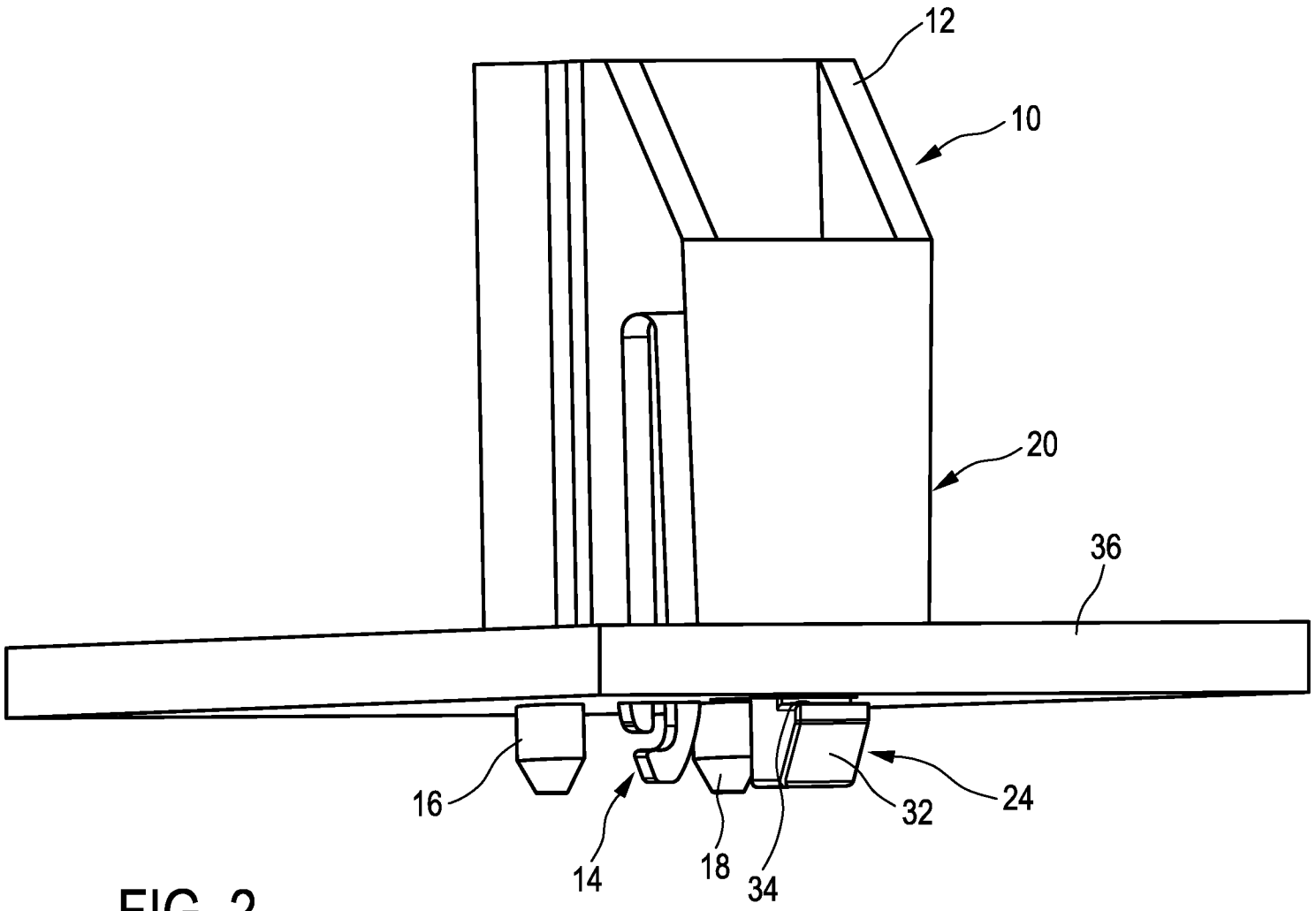
FIG. 2 shows the direct plug-in connector of FIG. 1 in the state in which it is inserted in a printed circuit board.

This state is illustrated in FIG. 2. As shown, the undercut 34 of the latching projection 24 is now arranged opposite the bottom side of the printed circuit board 36 and prevents the direct plug-in connector 10 in FIG. 2 from being pulled away from the printed circuit board 36 in the upwards direction. The contact 14 is arranged in a passage opening of the printed circuit board 36, which passage opening is embodied to be electrically conductive on its inner wall and is electrically connected to conductor tracks, not illustrated, on or within the printed circuit board 36. The positioning pins 16, 18 are accommodated in matching passage openings of the printed circuit board 36 and prevent twisting of the direct plug-in connector 10 or else tilting of the direct plug-in connector 10 relative to the printed circuit board 36. By way of the two positioning pins 16, 18 and the latching projection 24, the direct plug-in connector 10 can be securely fixed to the printed circuit board 36 and mechanical loadings are kept away from the contact 14 or the electrical connection between the contact 14 and, respectively, the inner wall of the passage opening of the printed circuit board 36 as far as possible. Accommodation of the contact 14 in the housing 12 with play in the lateral direction, that is to say from front left to back right and, respectively, from back right to front left in FIG. 2 also serves this purpose.

In order to remove the direct plug-in connector 10 from the printed circuit board 36 again, the latching arm 20 is pushed in the direction of the housing 12 in the region above the printed circuit board 36. The positioning pins 16, 18 in the passage openings of the printed circuit board 36 then prevent the housing 12 from giving way. The housing 12 can also be held between two fingers of a human hand. If the fingers are then pushed towards one another, the latching arm 20 is pushed in the direction of the housing 12. This leads to the latching projection 24 again being arranged below the passage opening in the printed circuit board 36 into which it was inserted. As a result, the undercut 34 is no longer situated opposite the bottom side of the printed circuit board 36, but rather below the passage opening. In this position in which the latching arm 20 and the housing 12 are pushed together, the direct plug-in connector 10 can then be pulled away from the printed circuit board 36 in the upwards direction again.

Figure 3:
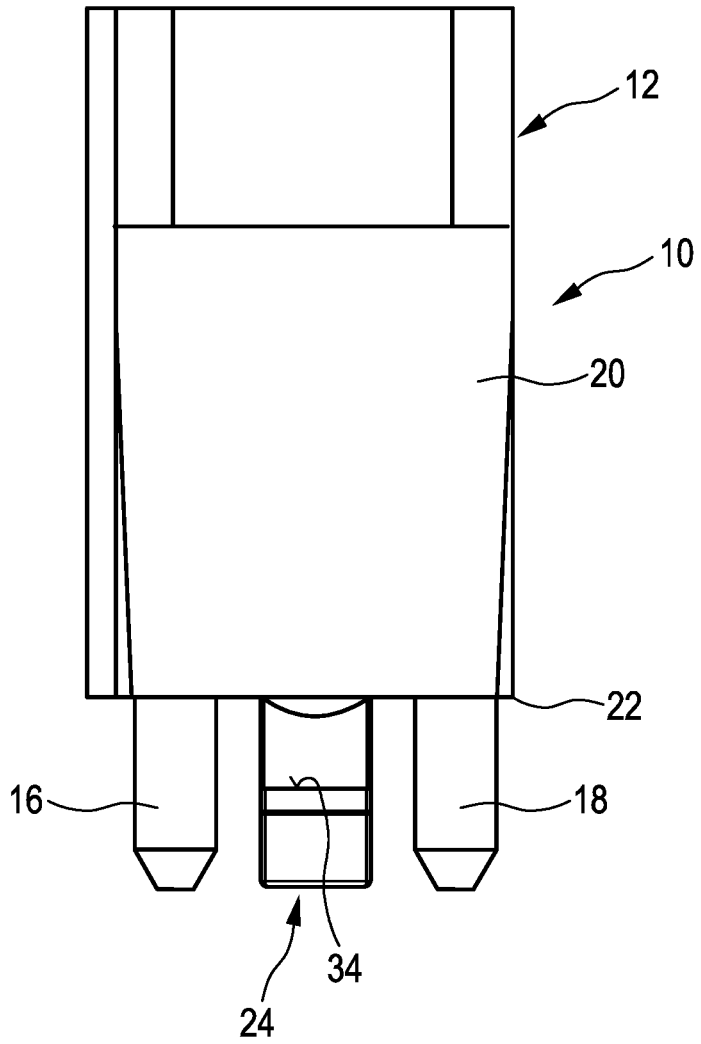
FIG. 3 shows the direct plug-in connector of FIG. 1 from the front.

FIG. 3 shows a side view of the direct plug-in connector 10, wherein the view is directed towards the latching arm 20. The said figure shows the latching projection 24 with the undercut 34 at the free end of the latching arm 20, which free end is at the bottom in FIG. 3. Furthermore, the said figure shows the positioning pins 16, 18 which start from the supporting face 22 of the housing 12. The contact 14 is concealed by the latching projection 24 in this view.

Figure 4:
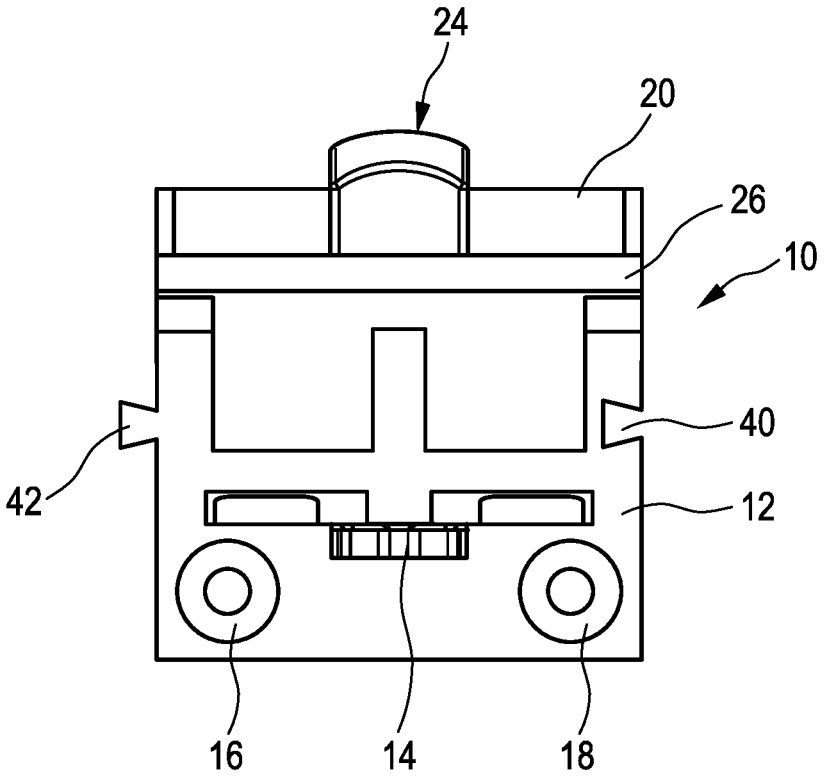
FIG. 4 shows the direct plug-in connector of FIG. 1 from below.

FIG. 4 shows a view of the direct plug-in connector 10 from below. This view shows the intermediate space 26 between the housing 12 and the latching arm 20. If the latching arm 20 is pushed in the direction of the housing 12, the width of the intermediate space 26 is reduced since the latching arm 20 then bends to a slight extent below the connection point 28 and the latching projection 24 is likewise moved in the direction of the housing 12.

A groove 40 with a dovetail-like cross section is shown on the right-hand-side side face of the housing 12 in FIG. 4. A dovetail-like projection 42 is shown on the opposite side face of the housing 12. If two of the direct plug-in connectors 10 are arranged next to one another, the projection 42 of the right-hand-side direct plug-in connector 10 can be inserted into the groove 40 of the left-hand-side direct plug-in connector. As a result, the housings 12 of two or more direct plug-in connectors 10 can be secured to one another. As a result, direct plug-in connectors comprising a plurality of contacts 14 can be easily constructed in a modular manner.

Figure 5:
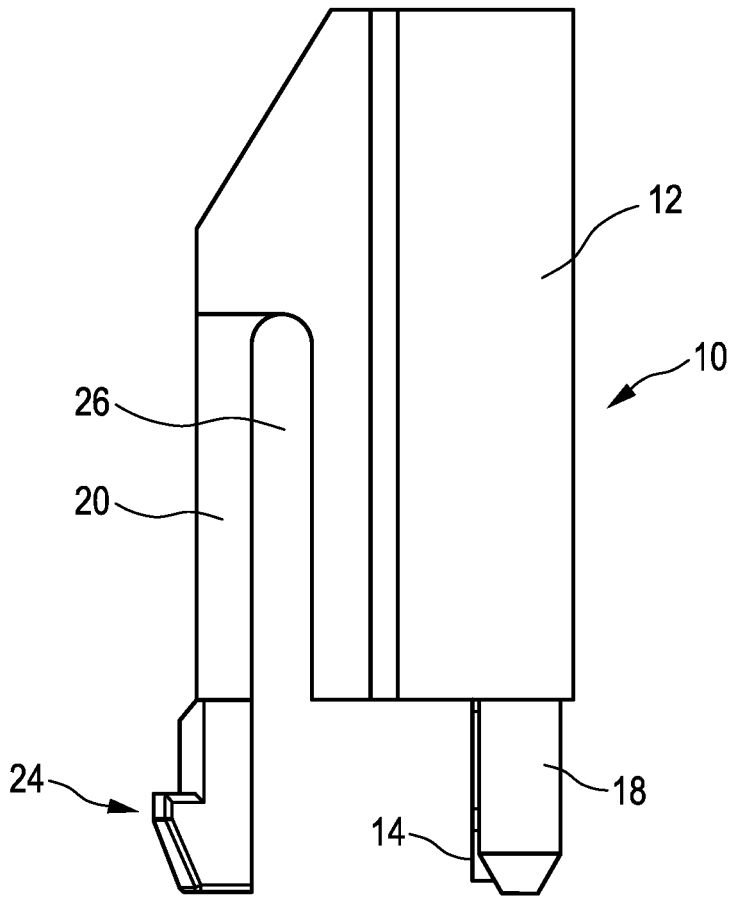
FIG. 5 shows the direct plug-in connector of FIG. 1 from the side.

FIG. 5 shows a side view of the direct plug-in connector 10. The positioning pin 18 conceals the entire rear positioning pin 16 and part of the contact 14. The said figure shows the latching arm 20 and the latching projection 24 at the bottom end of the latching arm 20. The said figure likewise clearly shows the intermediate space 26 between the latching arm 20 and the housing 12, the top end of which intermediate space is of arcuate configuration at the connection point between the latching arm 20 and the housing 12.

Figure 6:
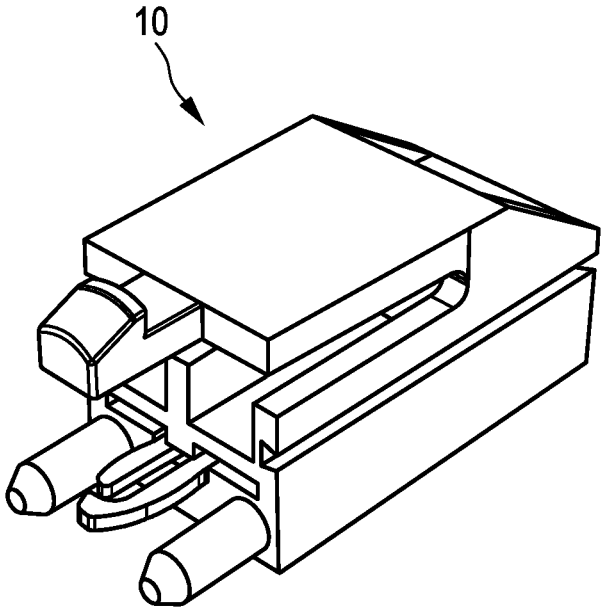
FIG. 6 shows the direct plug-in connector of FIG. 1 obliquely from below.

FIG. 6 shows a view of the direct plug-in connector 10 obliquely from below.

Figure 7:
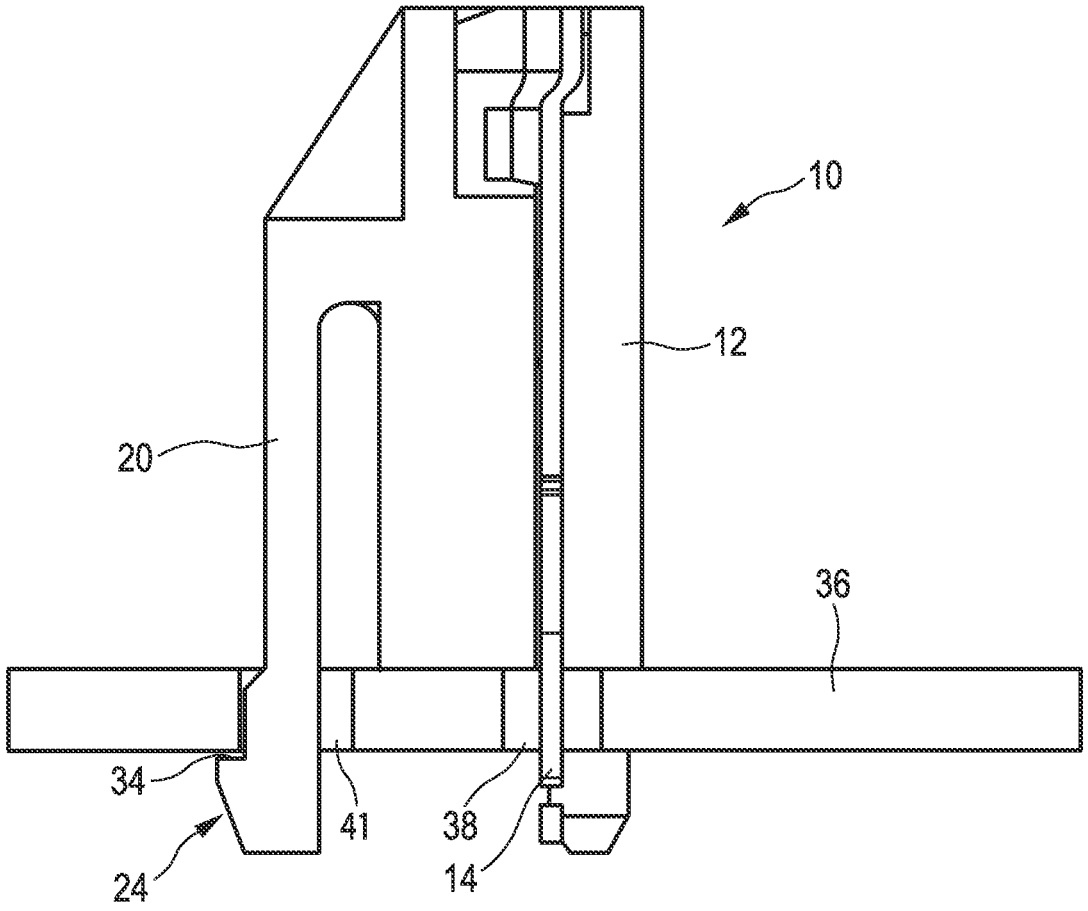
FIG. 7 shows a sectional view of the direct plug-in connector of FIG. 2.

FIG. 7 shows a sectional view of the direct plug-in connector 10 in the state in which it is inserted in the printed circuit board 36.

The contact 14 is now inserted into a passage opening 38 in the printed circuit board 36, the inner wall of which passage opening is electrically conductive and which passage opening is connected to a conductor track, not illustrated, on or within the printed circuit board 36.

The latching projection 24 at the free end of the latching arm 20 has snapped into a further passage opening 41, so that the undercut 34 is arranged opposite the bottom side of the printed circuit board 36. In order to release the direct plug-in connector 10 from the printed circuit board 36 starting from the position illustrated in FIG. 7, the latching arm 20 has to be pushed towards the housing 12 to the right in FIG. 7, as has already been stated. The latching arm 20 has to be moved in the direction of the housing 12 until the undercut 34 is arranged below the passage opening 41. In this state, the direct plug-in connector 10 can then be pulled away from the printed circuit board 36, in the upwards direction in FIG. 7.

Figure 8:
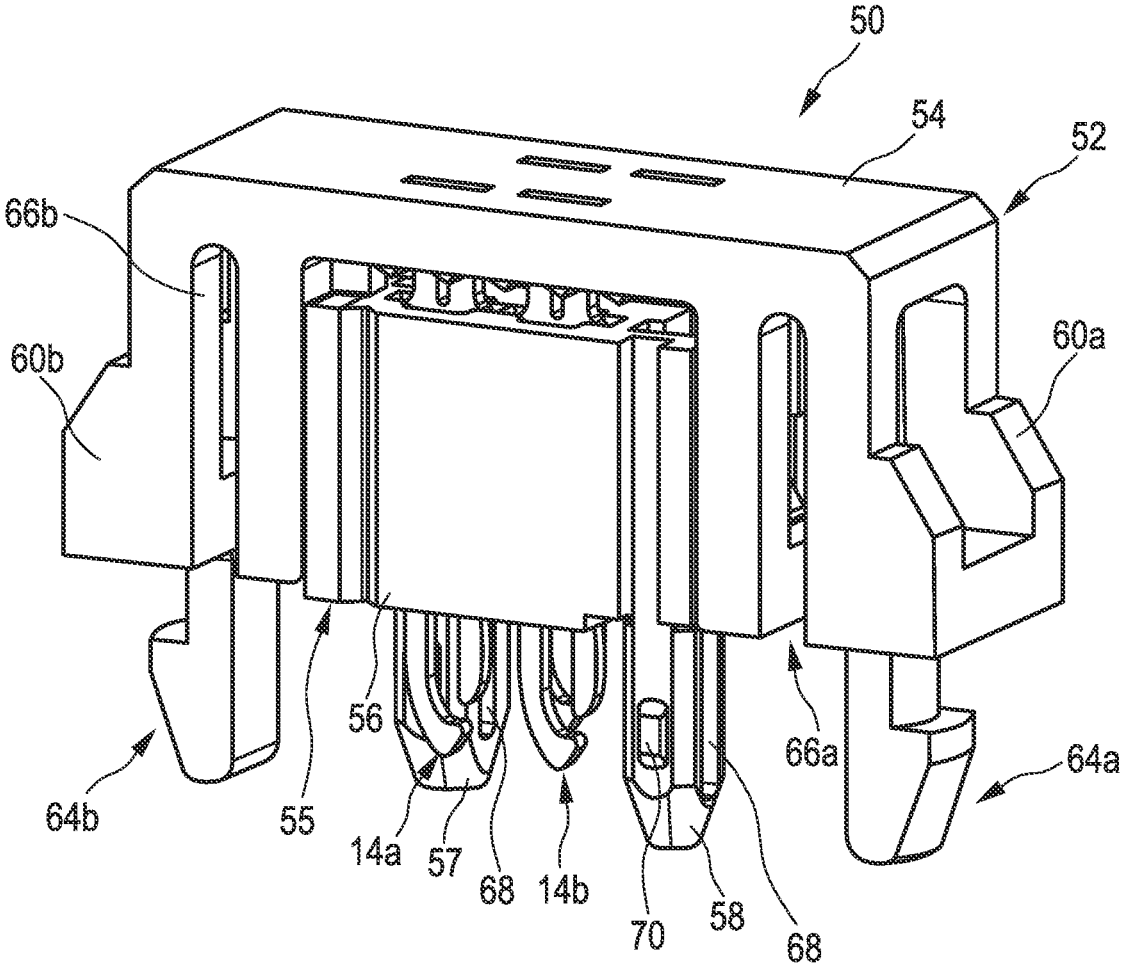
FIG. 8 shows a direct plug-in connector in line with a further embodiment of the invention obliquely from above.

FIG. 8 shows a direct plug-in connector 50 in line with a further embodiment of the invention. The direct plug-in connector 50 has a housing 52 which has a first housing part 54 and a second housing part 56. The first housing part 54 is of U-shaped design and has two latching arms 60*a*, 60*b*, which are each provided with a latching projection 64*a*, 64*b* at the bottom end in FIG. 8, on opposite outer sides of the housing. The latching projections 64*a*, 64*b* are directed away from one another. In order to be able to latch the latching projections 64*a*, 64*b* into matching passage openings in a printed circuit board, not illustrated in FIG. 8, the latching arms 60*a*, 60*b* therefore have to be moved towards one another. Each of the latching projections 64*a*, 64*b* is provided with a run-on slope. The latching arms 60*a*, 60*b* are each separated from the housing 64 by an intermediate space 66*a*, 66*b*, which intermediate spaces each end in an arcuate manner in the region of the respective connection point between the housing 54 and the latching arms 60*a*, 60*b*. The intermediate spaces 66*a*, 66*b* extend starting from a supporting face 72 of the housing 54 to a height of approximately 8/10 to 9/10 of the housing 54. The connection point between the latching arm 60*a* and, respectively, the latching arm 60*b* and the housing 54 is of comparatively flexible design as a result, so that the latching arms 60*a*, 60*b* can be pressed in the direction of the housing 54 without problems.

The second housing part 56 is provided with a total of four contacts 14*a*, 14*b*, 14*c* and 14*d*, wherein the contacts 14*a* to 14*d* are partially concealed in the view of FIG. 8. Furthermore, the second housing part 56 is provided with two positioning pins 57, 58. The positioning pins 57, 58 are designed as cylindrical pins with truncated cone-like free ends and each have a central slot 68. As a result, the positioning pins 57, 58 can be slightly compressed level with the slot 68. The positioning pins 57, 58 are each provided with a latching projection 70 on their outer side. This latching projection is substantially smaller than the latching projections 64*a*, 64*h* and is intended merely to provide a slight clamping effect or latching effect in the associated passage openings of the printed circuit board.

Figure 9:
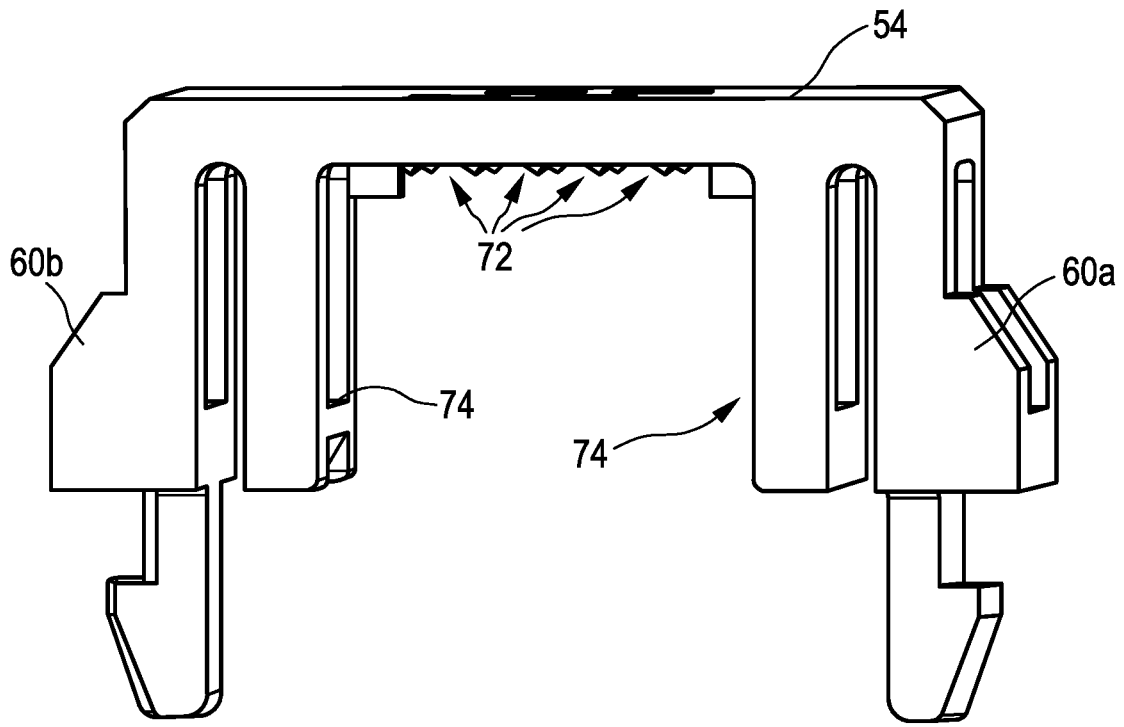
FIG. 9 shows a first housing part of the direct plug-in connector of FIG. 8.

FIG. 9 shows only the first housing part 54. The said figure clearly shows the U shape of the first housing part 54 with the two latching arms 60*a*, 60*b*. The bottom side of the base of the first housing part 54, which bottom side faces the second housing part 56 in the state in which the two housing parts 54, 56 are connected, is provided with positioning devices 72 for cable strands. The positioning devices 72 can also be provided, for example, for the individual cable strands of a flat cable. A flat cable is inserted into the positioning devices 72 and secured against slipping in this way. If the first housing part 54 is then pushed onto the second housing part 56 until the position illustrated in FIG. 8 is reached, the top ends of the contacts 14*a* to 14*d*, which top ends are designed as insulation-displacement contacts, enter matching passage openings in the base of the first housing part 54 and in the process sever the insulations of the cable strands of the flat cable. As a result, the cable strands of a flat cable can be contacted and fixed by simply pushing the first housing part 54 onto the second housing part 56.

The second housing part 56 is provided with latching hooks, not shown in FIG. 8, which then engage into matching undercuts 74 on the inner sides of the limbs of the first housing part 54 and as a result secure the housing part 54 to the second housing part 56. In this state in which the two housing parts 54, 56 are secured to one another and in which, as described, contact is already made with cable strands, the direct plug-in connector 50 can then be mounted onto a printed circuit board 36, as illustrated in FIG. 10.

Figure 10:
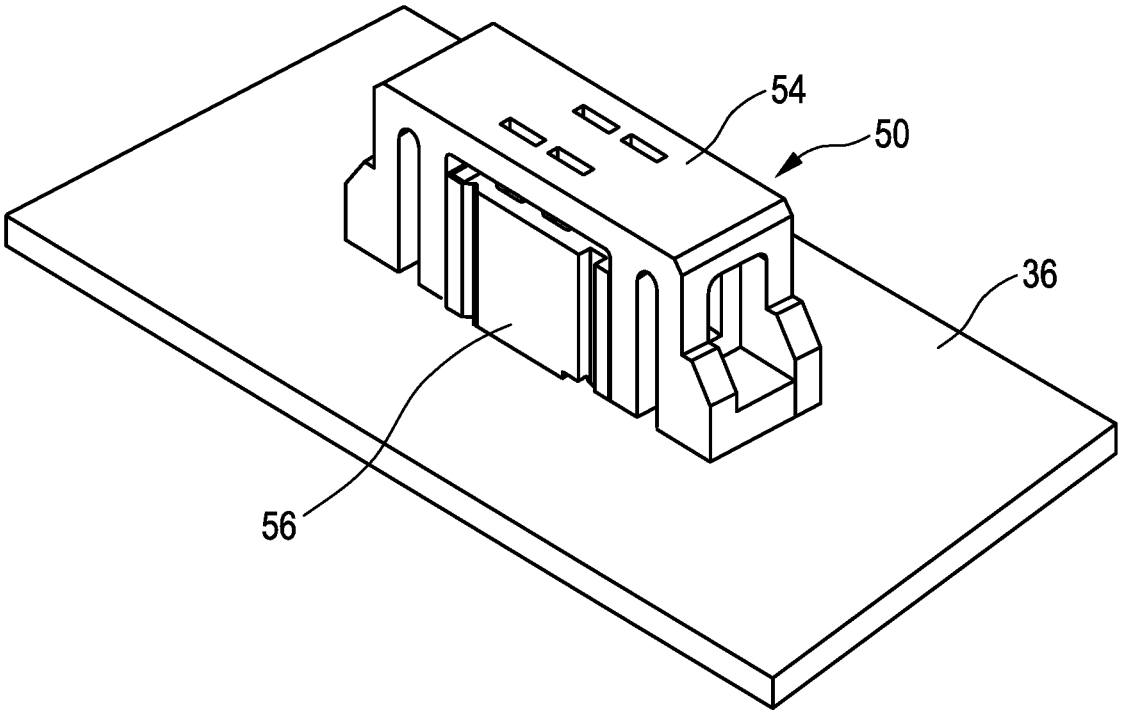
FIG. 10 shows the direct plug-in connector of FIG. 8 in the state in which it is inserted in a printed circuit board.
Figure 11:
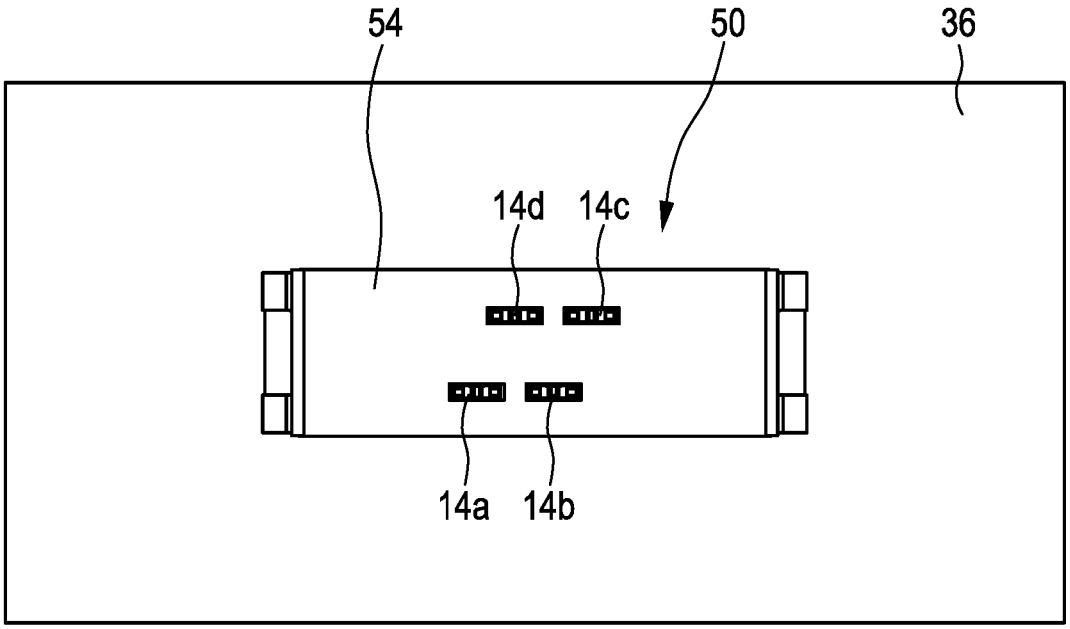
FIG. 11 shows the direct plug-in connector of FIG. 10 from above with the first housing part removed.

FIG. 11 shows the direct plug-in connector 50 of FIG. 10 from above. This view shows the passage openings in the first housing part 54 and the contacts 14*a*, 14*b*, 14*c* and 14*d* which are arranged in the said passage openings. The view of FIG. 11 looks at the top ends of the contacts 14*a* to 14*c*, which top ends are designed as insulation-displacement contacts. The cable strands of a flat ribbon cable are not illustrated for reasons of clarity.

Figure 12:
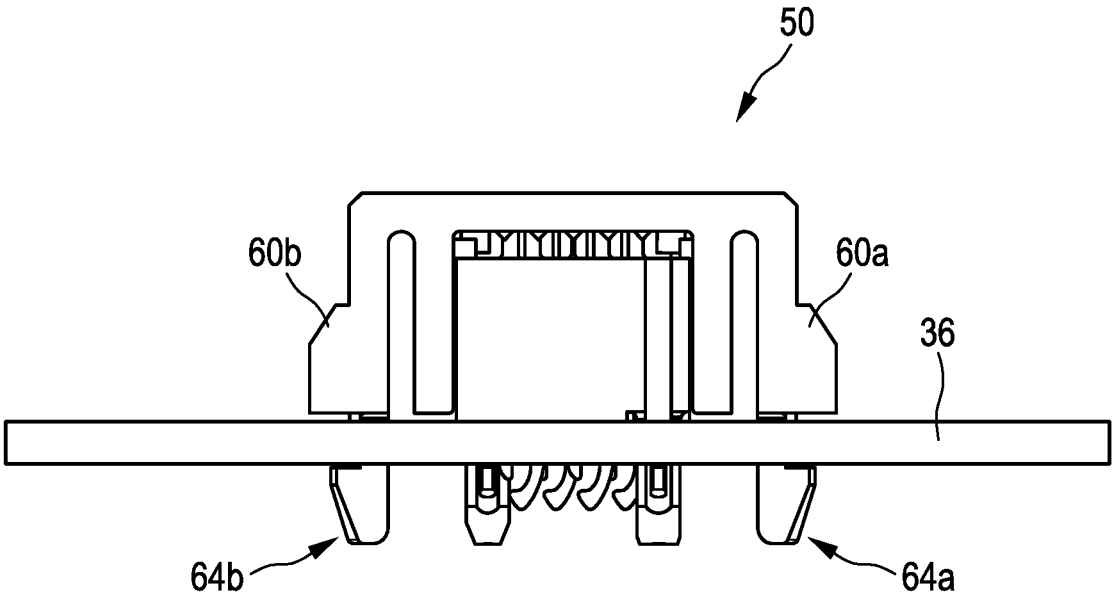
FIG. 12 shows the direct plug-in connector of FIG. 10 from the side.

FIG. 12 shows the direct plug-in connector 50 of FIG. 10 from the side. The said figure clearly shows that the two latching hooks 64*a*, 64*b* are situated opposite the bottom side of the printed circuit board 36 by way of the respective undercuts. In order to pull the direct plug-in connector 50 away from the printed circuit board 36 again, the two latching arms 60*a*, 60*b* would have to be pushed towards one another until the latching projections 64*a*, 64*b* are arranged wholly below the associated passage openings in the printed circuit board 36.

Figure 13:
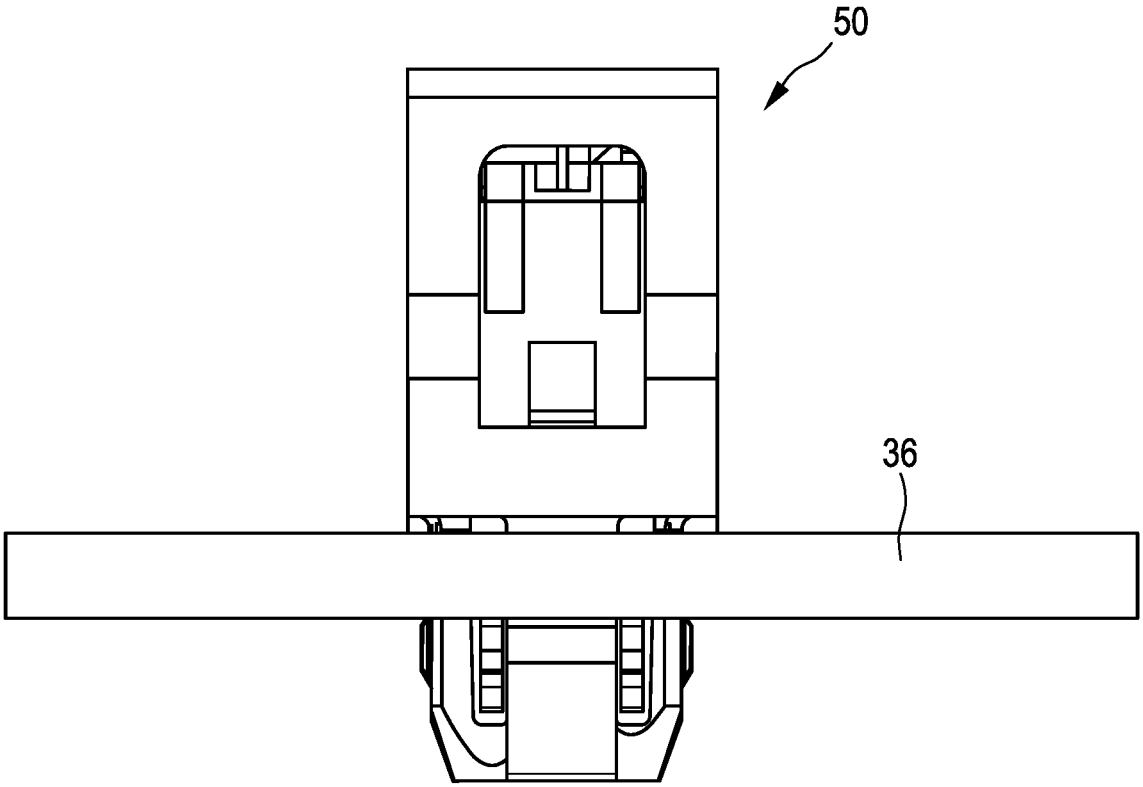
FIG. 13 shows the direct plug-in connector of FIG. 12 in a side view rotated through 90°.

FIG. 13 shows the direct plug-in connector 50 of FIG. 10 from the side.

Figure 14:
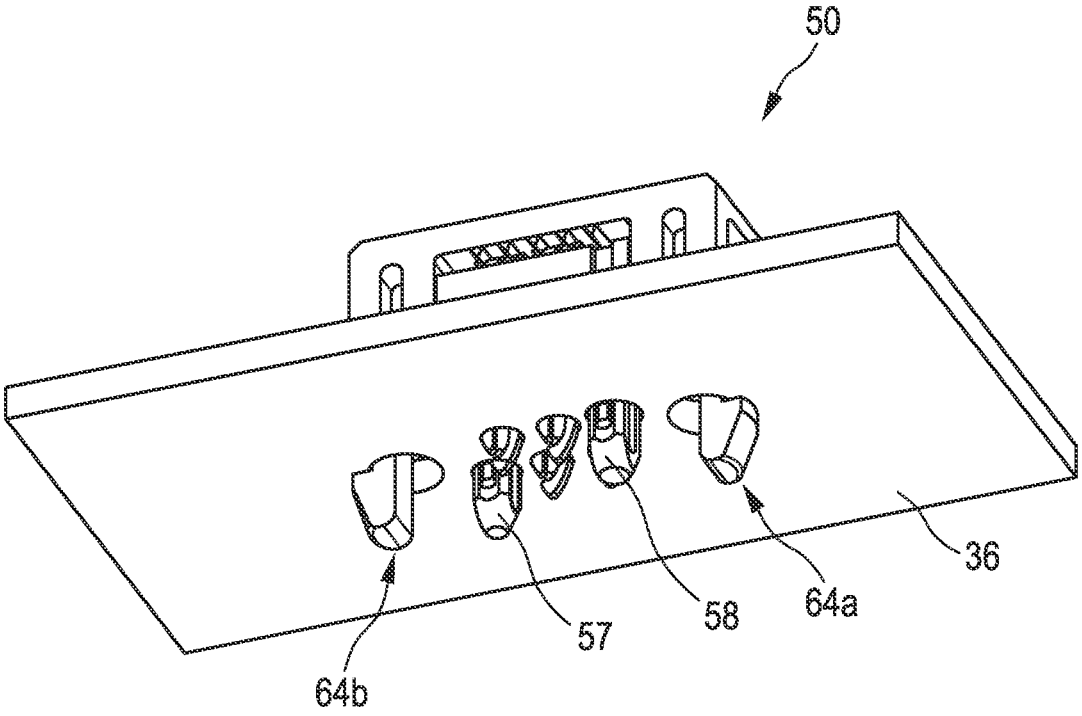
FIG. 14 shows the direct plug-in connector of FIG. 10 in a view obliquely from below.

FIG. 14 shows the direct plug-in connector 50 of FIG. 10 obliquely from below. This view clearly shows that the latching projections 64*a*, 64*b* engage behind the printed circuit board 36. The said figure also clearly shows how the positioning pins 57 and 58 engage into matching passage openings in the printed circuit board 36.

Figure 15:
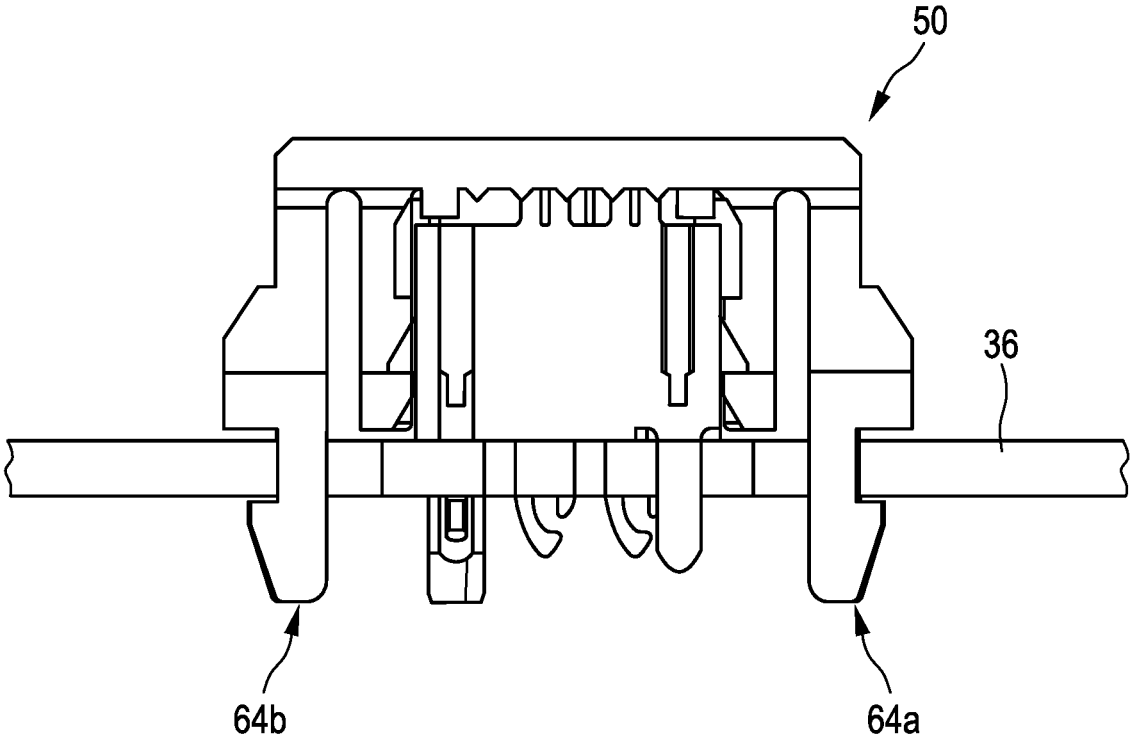
FIG. 15 shows a sectional view of the direct plug-in connector of FIG. 12.

FIG. 15 shows a sectional view through the direct plug-in connector 50 of FIG. 10. Here, the sectional plane passes through the latching projections 64*a*, 64*b*.

Figure 16:
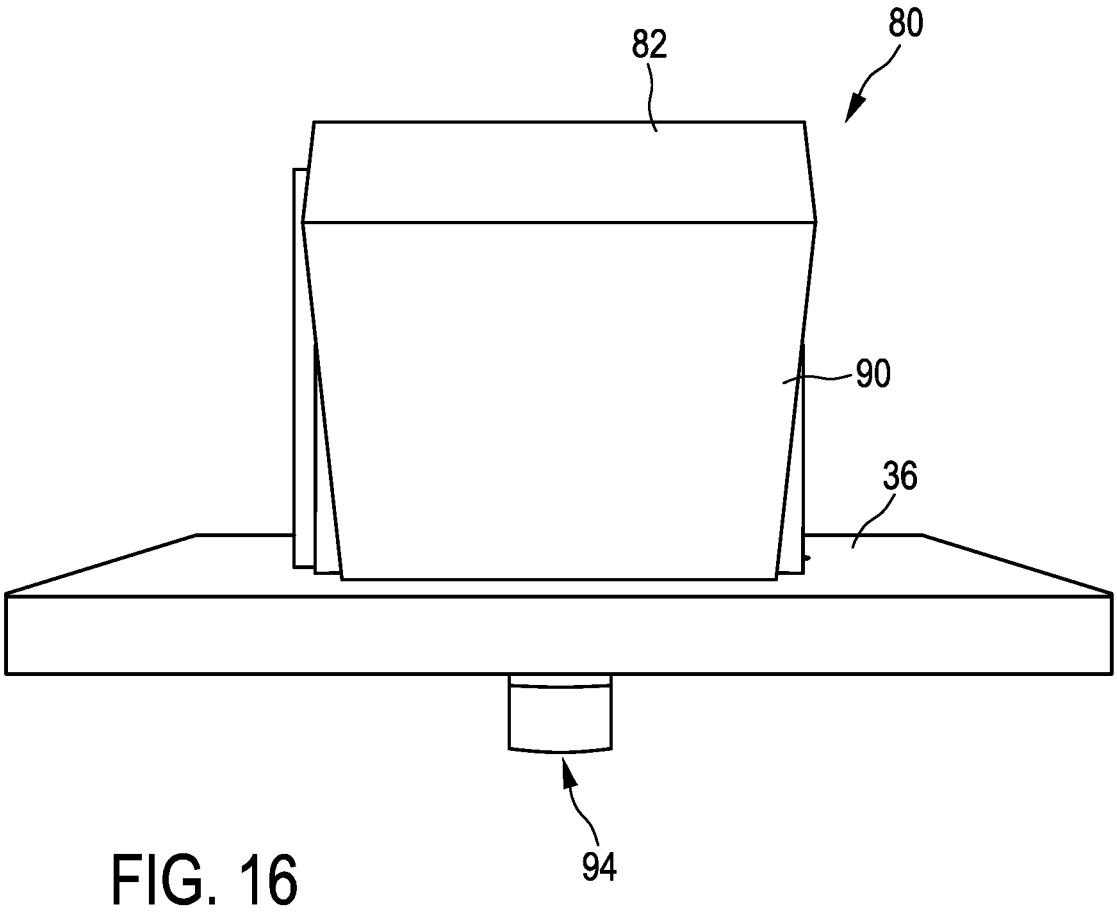
FIG. 16 shows a view of a direct plug-in connector in line with a further embodiment of the invention obliquely from above.

FIG. 16 shows a further direct plug-in connector 80 in line with a further embodiment of the invention in the state in which it is mounted onto a printed circuit board 36. The direct plug-in connector 80 is provided with a housing 82 which is integrally connected to a latching arm 90 which has a latching projection 94 arranged at its bottom free end.

Figure 17:
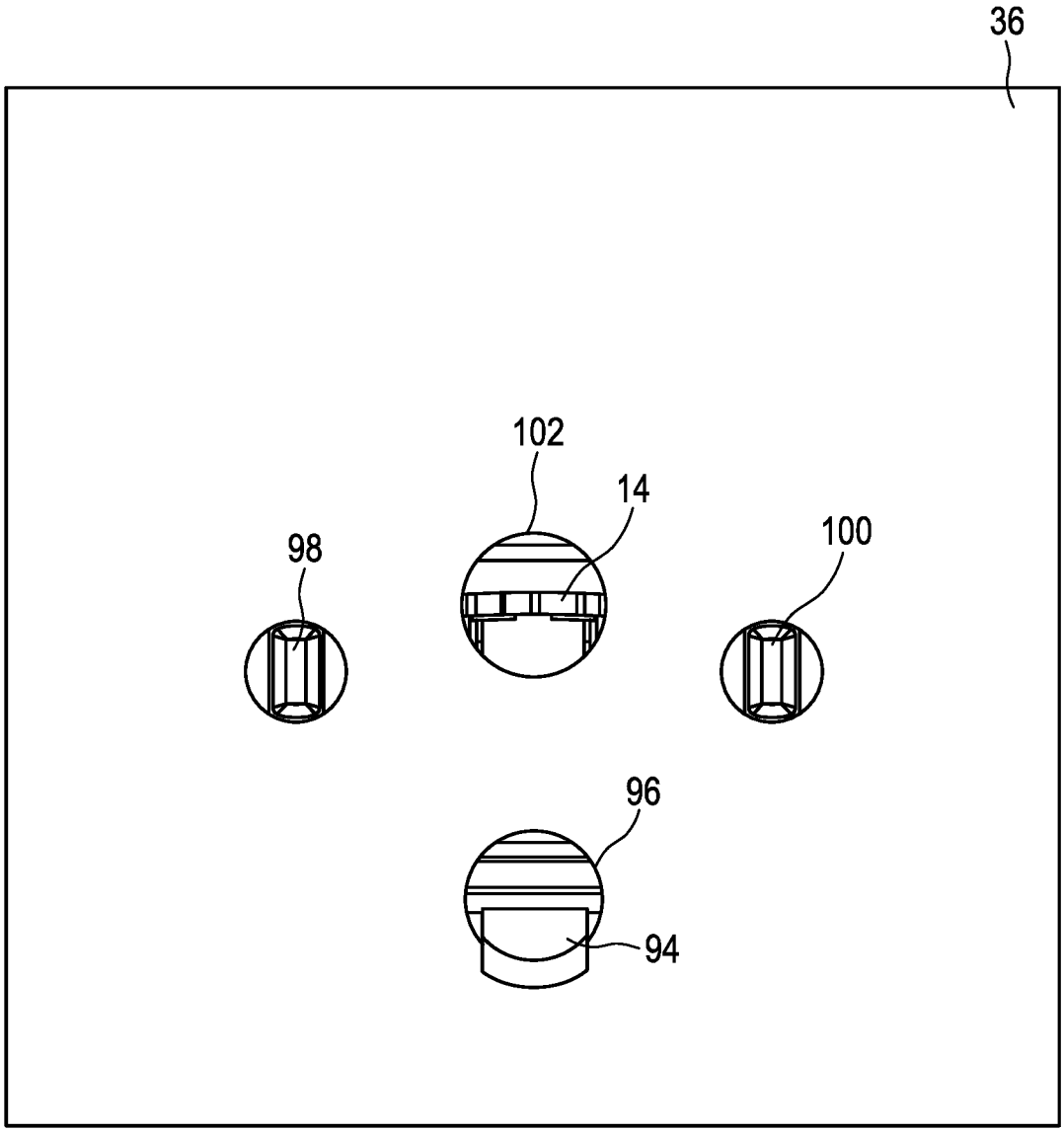
FIG. 17 shows a view of the direct plug-in connector of FIG. 16 from below.

FIG. 17 shows the printed circuit board 36 of FIG. 16 from below, wherein the direct plug-in connector 80 is largely concealed. The said figure shows the latching projection 94 which is situated opposite the bottom side of the printed circuit board 36 by way of its undercut and was previously pushed through a matching passage opening 96 in the printed circuit board 36. The housing 82 is provided with two positioning pins 98, 100 which were likewise pushed into matching passage openings in the printed circuit board 36. The contacts 14 of the direct plug-in connector 80 have likewise been pushed into a matching passage opening 102 of the printed circuit board 36, which passage opening is of electrically conductive design on its inner wall.

Figure 18:
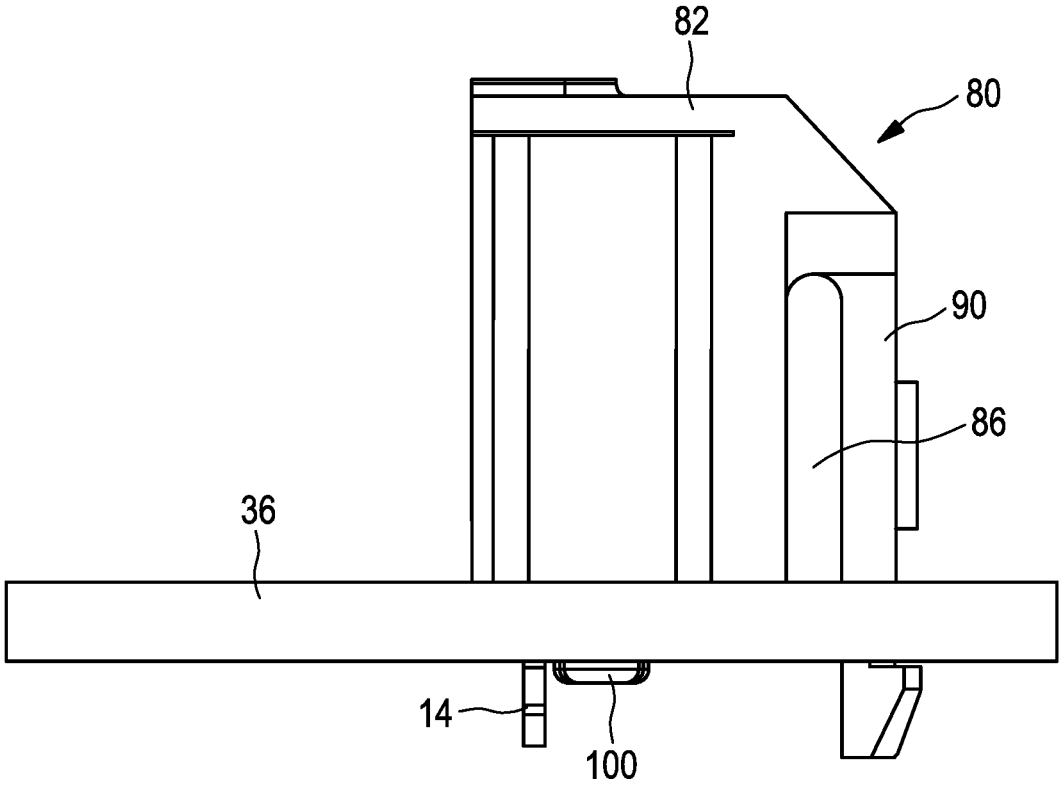
FIG. 18 shows a view of the direct plug-in connector of FIG. 16 from the side.

FIG. 18 shows a side view of the direct plug-in connector 80 of FIG. 16. An intermediate space 86 is arranged between the latching arm 90 and the housing 82, the said intermediate space ending in an arcuate manner in the region of the connection point at which the latching arm 90 and the housing 82 are integrally connected to one another. The housing 82 and the latching arm 90 can be integrally produced by means of plastic injection moulding for example.

Figure 19:
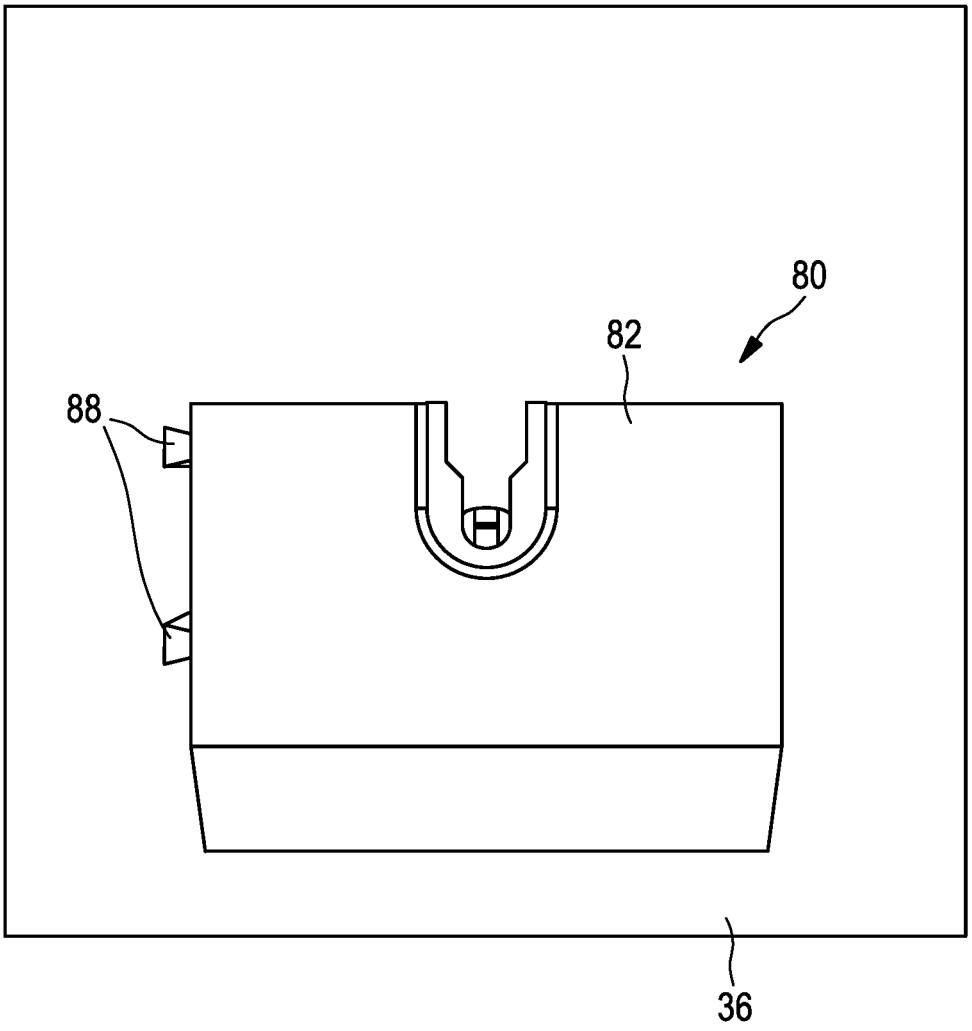
FIG. 19 shows a view of the direct plug-in connector of FIG. 16 from above.

FIG. 19 shows a view of the direct plug-in connector 80 from above. Two projections 88 of dovetail-like cross section are shown on the side face of the housing 82 on the left-hand side in FIG. 19. If a plurality of housings 82 are arranged next to one another and connected to one another, the projections 88 can be pushed into matching grooves, not shown in FIG. 19 however, on the side face of a further housing 82 on the right-hand-side in FIG. 19.

The invention claimed is:

1. A direct plug-in connector for making electrical contact with printed circuit boards, comprising a housing and at least one contact, which is connected to the housing, for insertion into a first passage opening of a printed circuit board, which first passage opening is electrically conductive on an inner wall, having at least one latching device for securing the housing on the printed circuit board, wherein the latching device has at least one elastically resilient latching arm which is integrally connected to the housing and has a latching projection in the region of its free end, wherein the latching arm and the housing are separated by means of an intermediate space, wherein the housing has at least one further positioning projection which is rigidly and integrally connected to the housing and protrudes beyond a supporting face of the housing, wherein the housing is of two-part design, wherein a first housing part is provided with the at least one latching arm and a second housing part is provided with the contact, wherein the first housing part is designed in general in a u shape with two limbs and a base connecting the two limbs and the second housing part is accommodated between the limbs of the first housing part, and further wherein the first housing part engages over the second housing part such that the second housing part is between the first housing part and the printed circuit board.

2. The direct plug-in connector according to claim 1, wherein a side face of the housing and a side face of the latching arm, which side faces delimit the intermediate space, merge with one another in an arcuate manner at a connection point at which the latching arm and the housing are connected to one another.

3. The direct plug-in connector according to claim 1, wherein the latching projection at the free end of the latching arm is directed away from the housing.

4. The direct plug-in connector according to claim 1, wherein slope which leads onto the latching projection is provided at the free end of the latching arm.

5. The direct plug-in connector according to claim 1, wherein the intermediate space, which separates the latching arm and the housing, runs perpendicularly to a supporting face of the direct plug-in connector on the printed circuit hoard and in a straight line.

6. The direct plug-in connector according to claim 1, wherein the housing has a latching arm on each of two opposite side faces.

7. The direct plug-in connector according to claim 1, wherein the housing is provided with at least one dovetail-like groove and at least one dovetail-like tongue.

8. The direct plug-in connector according to claim 1, wherein the contact has at least one insulation-displacement contact for connection to at least one cable strand, wherein the first housing part bears against the insulation-displacement contact in the state in which the first housing part and the second housing part are connected.

9. The direct plug-in connection comprising at least one direct plug-in connector according to claim 1 and one printed circuit board comprising at least one first passage opening, which is electrically conductive on the inner wall, for inserting the contact and at least one second passage opening for inserting the latching projection and/or a positioning projection of the housing.

10. The direct plug-in connector according to claim 1, wherein a height of the intermediate space between the supporting face and a connection point at which the latching arm and the housing are connected to one another corresponds at least to half the height of the housing.

11. The direct plug-in connector according to claim 10, wherein a height of the intermediate space lies between half and 9/10 the height of the housing.

12. The direct plug-in connector according to claim 1, wherein the base of the first housing part is arranged on top of an upper side of the second housing part in an assembled state of the direct plug-in connector, an upper side of the first housing part facing away from the printed circuit board when the direct plug-in connector is arranged on the printed circuit board.

13. The direct plug-in connector according to claim 12, wherein the first housing part encompasses only the upper side and two opposite side faces of the second housing part.

* * * * *